US009552703B2

(12) United States Patent
Shoemaker, Jr.

(10) Patent No.: US 9,552,703 B2
(45) Date of Patent: Jan. 24, 2017

(54) VACUUM CRANE ARCADE GAME

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 14/838,980

(22) Filed: Aug. 28, 2015

(65) Prior Publication Data

US 2016/0379450 A1 Dec. 29, 2016

Related U.S. Application Data

(63) Continuation-in-part of application No. 14/751,090, filed on Jun. 25, 2015.

(51) Int. Cl.
*A63F 9/30* (2006.01)
*G07F 17/32* (2006.01)

(52) U.S. Cl.
CPC ..... *G07F 17/3297* (2013.01); *A63F 9/30* (2013.01)

(58) Field of Classification Search
CPC ..... A63F 9/30; G07F 17/3297
USPC ..... 273/447
See application file for complete search history.

(56) References Cited

U.S. PATENT DOCUMENTS 5,513,772 A * 5/1996 Glaser ..... G07F 17/32 221/199
5,855,374 A * 1/1999 Shoemaker, Jr. ..... A63F 9/30 273/447
6,770,001 B1 * 8/2004 Shoemaker, Jr. ..... A63F 9/30 273/448
7,857,318 B1 * 12/2010 Shoemaker, Jr. ..... A63F 9/30 273/447
8,070,167 B1 * 12/2011 Shoemaker, Jr. ..... A63F 9/30 273/447
8,079,596 B1 * 12/2011 Shoemaker, Jr. ... G07F 17/3297 273/447
8,448,948 B1 * 5/2013 Shoemaker, Jr. ..... A63F 9/0079 273/447
8,678,395 B2 * 3/2014 Shoemaker, Jr. ..... F41J 5/24 273/454
8,882,111 B2 * 11/2014 Shoemaker, Jr. ..... G07F 17/32 273/447
2013/0214491 A1 * 8/2013 Shoemaker, Jr. ..... F41J 5/24 273/348

* cited by examiner

*Primary Examiner* — Raleigh W Chiu
(74) *Attorney, Agent, or Firm* — Fulwider Patton LLP

(57) ABSTRACT

An arcade target game uses an extendable extraction device to enter a tube of cards in a horizontal direction. The prizes are protected by the tube's outer wall that limits successful attempts to those tries that avoid the wall. A vacuum source allows the extraction device to capture the prize if the extraction device successfully enters the tube. The extraction device's effective radius can be adjusted by extending projections that reduce the tolerance between the disk and the tube's outer wall.

8 Claims, 15 Drawing Sheets

TO VACUUM SOURCE
100
102
108
110
112
112
106
104
D
115
51a
50
51

VACUUM CRANE ARCADE GAME

CROSS-REFERENCES TO RELATED APPLICATIONS

This application in a continuation-in-part of U.S. patent application Ser. No. 14/751,090, filed Jun. 25, 2015, incorporated by reference in its entirety.

BACKGROUND OF THE INVENTION

Crane-type or "claw machine" arcade games are popular amusement devices often provided in game arcades, stores, or other public places. In these types of games, prize objects are provided within the game itself and are viewable by a player through transparent glass enclosure or the like. Upon the insertion of a coin or other monetary input into the game, the player controls a mechanical claw or extraction device with a joystick, buttons, toggle switch, or other control to maneuver the extraction device over a prize. The claw or extraction device is then lowered toward the prize upon activation either automatically by a controller such as a computer or manually by the player, depending on the particular game. The claw or extraction device is then either automatically opened when it reaches the level of the prizes or is opened under the player's control. After a predetermined amount of time, the claw may be automatically closed and elevated. Depending upon the claw's proximity and position with respect to the prize, the claw may or may not be able to grasp a prize and hold onto the prize as the claw is raised. The controller then moves the claw or extraction device over to a dispensing container and opens the claw, allowing the prize (if any is held) to drop into the dispensing chute and to be guided through the dispenser to an opening accessible to the player. In a common implementation, a sensor within the dispenser detects whether a prize has been won by the player. After the claw is opened over the dispenser, the controller moves the claw to its original starting position and waits for another insertion of the coin (unless the player is provided with multiple tries).

The prizes that the operator of a claw-type crane game can provide in the game are usually limited in selection due to the limitations of a mechanical claw. Since the claw must surround an object to be able to pick it up, most prizes in a claw-type crane game have been limited to plush animals, stuffed dolls, or other soft, rough-surfaced merchandise that can be surrounded and grabbed by the claw fingers and raised from the supporting surface. Usually, flat, smooth or thin objects are not able to be picked up and held by the claw. However, a large number of flat, smooth, and thin objects are desirable to used as prizes in a crane-type game, such as smooth-surfaced spheres or eggshell containers, boxes, gumballs, cups, bulbs, trading cards, etc. Players desire to win these types of items and operators desire to provide them; however, the standard claw type mechanism cannot be used to pick them up.

One solution to the inability of claw-type cranes to pick up these objects is to provide a different type of extraction device. One type of device that is used is a vacuum device that uses air suction to grab and hold an object. In U.S. Pat. No. 5,513,772 of Glaser (incorporated herein by reference in its entirety), a vacuum embodiment of a crane pick-up game is disclosed in which a vacuum motor is suspended from a string and concealed by a facade or enclosure. The player may move the motor and lower the motor towards a field of prizes similarly to the claw in claw-type crane games. A spinning fan within the motor creates a suction force that is used to pick up and hold prizes. An orifice with a screen is used to prevent items from being sucked into the orifice. Prizes captured and held by the suction are dispensed to the player through a dispenser.

More recent vacuum crane games have improved on the concept and made the game more challenging. In my U.S. Pat. No. 5,855,374 (also incorporated herein by reference in its entirety), a vacuum crane game is disclosed wherein the vacuum head is used to pick up one of the prizes using a suction force that is provided by a vacuum pump coupled to the vacuum head by a hose and located away from the vacuum head. Moving the pumping apparatus away from the crane head mechanism provides greater maneuverability than previous devices that carried the pumping equipment at the crane head. In general, the vacuum crane game is characterized by a vacuum extraction device positioned above the prize or target area and may be moved along a horizontal axis above the prize area. The extraction device includes a vacuum head that may be raised and lowered toward a turntable in a z-direction. The vacuum head is operative to pick up one of the prizes using a suction force that is provided by a vacuum pump coupled to the vacuum head by a hose. The vacuum pump is located away from the vacuum head to allow the vacuum head to move without interference. The player may control the movement of the extraction device to position the vacuum head over the prize area at a desired position, lower the vacuum head, and pick up a prize using the suction force. The extraction device is moved to a dispenser area and the suction force is removed, common with an electronic relief valve, to allow the prize to be dispensed to the player. The disclosure of my '374 patent is incorporated fully herein by reference. In another embodiment, the vacuum head may be moved in both x- and y-directions above the prize area and the turntable is omitted. Also, the vacuum can be created by a plunger type suction device, but a vacuum hose connection is preferable in some cases because disengagement is easily accomplished by turning off the vacuum to open an electronic relief valve.

With vacuum crane games, it is desirable to provide prizes having smooth continuous surfaces such that a seal can be formed by the vacuum head against the prize. Without a seal, the vacuum head cannot effectively apply suction to the prize sufficiently to enable the prize to be lifted out of the prize bin. As a consequence, prizes such as jewelry, candy, and toys are typically enclosed in transparent or opaque spheroids such as spheres and egg-shaped plastic containers. Such spheroids will have exteriors that meet the requirement of smooth, continuous surfaces allowing the vacuum head to make sealing contact. An example of this type of prize collection for a vacuum crane game can be found in my U.S. Pat. No. 6,598,881, entitled "Crane Game with Prize Redistribution Mechanism" and incorporated herein fully by reference.

The present inventor is also the sole inventor of a vacuum extraction device, U.S. Pat. No. 8,070,167, that required the crane to fit into a cup or receiving container before picking up the target. The difficulty of the game could be adjusted depending upon the size of the container and the length of projectiles that extended from the extraction device, making the margin for error smaller or larger depending upon the tolerances. The '167 patent is incorporated fully herein by reference. The foregoing demonstrate some of the arcade type games credited to the present inventor. However, the advent of the vacuum crane has led to the ability to include prizes of higher value, which in turn attracts more customers and more profit for the owner of the games. However, with greater value prizes comes the need to more accurately control the win percentage of the games to prevent the games from being won too easily.

Plastic, cardboard, magnetic strip, laminated, and many other "gift cards" have become a new kind of currency which has invaded the arcade industry. These gift cards can be awarded as prizes for various purchases. These cards can then be redeemed by players for merchandise, and can be a valuable source of revenue for the supplier. First, in many cases the gift cards can only be redeemed at the issuer's establishment, ensuring that the money spent on the gift card is used to purchase the issuer's goods, and is an effective way to get customers into their stores. The cards can also have advertisements, store information, and other useful information on the card that the issuer can use to advertise its business. The cards are easy to use, make good gifts, and can be discarded when depleted. For this application, the term "gift card" is to be understood as any card having either a magnetic strip, printed information, or other insignia that is used to store or reflect a designated value, or any other flexible thin card that is used in commerce.

While the cards may be excellent prizes that will attract new players, there is not an established way to incorporate the gift cards into the arcade games themselves. The present invention is to overcome this issue.

SUMMARY OF THE INVENTION

The present invention is an arcade game based on crane technology, but uses a vacuum extraction device to extract gift cards from a hollow silo or tube. The player aims the extraction device in line with an opening in the silo, which can vary in size and shape to affect the skill needed for extraction and the size of the prize. In a preferred embodiment, the extraction device may include projections that alter the difficulty of the game, where the projections can be adjusted to vary in a radial direction. In a preferred embodiment, the gift cards are stacked in the silo, and thus must be extracted out of the silo walls by the extraction device to achieve extraction (whereupon the player can claim the prize). If the extraction device is correctly aligned with the gift card stack, when inserted into the silo the extraction device vacuum will actuate and the card will be sucked onto the extraction device and withdrawn out of the silo. If the player does not align the extraction device correctly on the other hand, the extraction device will make contact with the wall of the silo, tilting or blocking the extraction device and causing the extraction device to withdraw (ending the attempt).

A very important value to the present invention is the number of cards that can be disbursed before refilling the game. Capsules, stuffed animals and wrapped prizes take up a lot of room, limiting a very small game to few wins, thus crane games have increased in size to accommodate more prizes. Gift cards are effectively paper thin and a hundred or more cards per inch in silo depth can be achieved. Thus a game that is twelve inches square can hold many more prizes than a conventional crane forty-eight inches square. This can be multiplied by using a conveyor of silos, or a rack of conveyors, each silo holding up to a hundred cards or more. A card issued in a dollar store could be worth any item in the store, increasing the choice of prizes to thousands of items.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
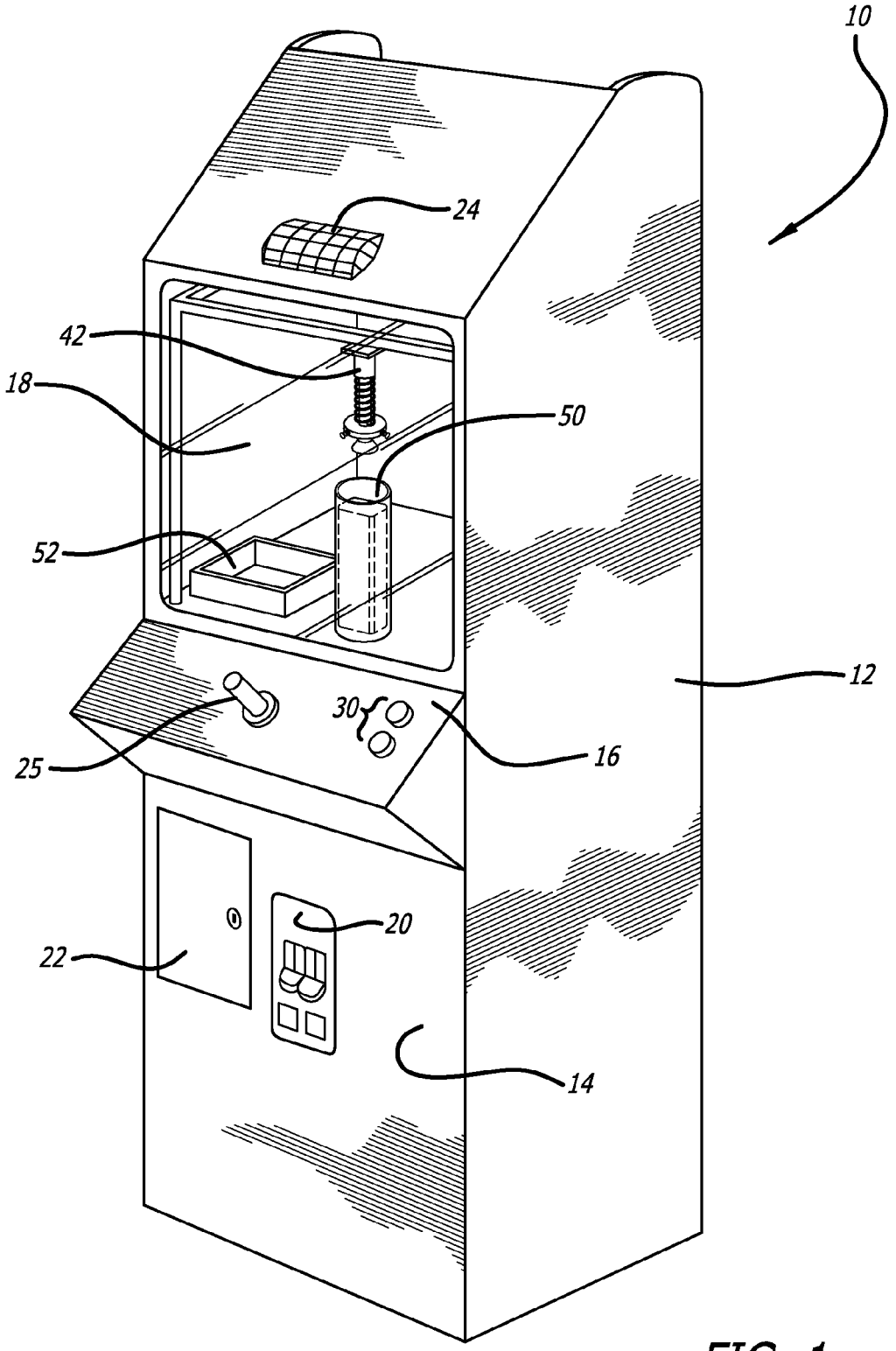
FIG. 1 is an elevated perspective view of a game embodying a first preferred embodiment of the present invention.

FIG. 1 is a perspective view of one embodiment of a game apparatus 10 in accordance with the present invention. Game apparatus 10 includes a housing 12, front panel 14, and a playing area 18. Housing 12 provides a support for the other components of the game apparatus. Housings can take a wide variety of forms; for example, as shown in FIG. 1, housing 12 may be of the stand-up variety in which a player stands in front of the game or sits on a stool when playing the game. In other embodiments, other types of housings may be provided. For example, a counter-top housing, including approximately the upper half of housing 12 shown in FIG. 1, can be used when the game apparatus 10 is desired to be placed on a table, counter top or other similar surface.

Front panel 14 includes a player control panel 16 that includes player controls 30. Front panel 14 includes a coin deposit slot 20, and a speaker 24 may also be provided on the housing 12. Coin deposit slot 20 may be more generally thought of as a payment area, where the game can accept payment in the form of currency, coins, game tokens, bills, tickets, and the like. In some embodiments, other types of monetary input may also be provided using a magnetic card reader 21 to read a card with a magnetic strip that holds game credit information, or a bank card such as a credit card, debit card, etc. A token deposited in coin deposit slot 20 (or other payment method) starts a game. Dispenser compartment 22 is used to provide access to the retrieval bin 52 in the event of a successful attempt by the player.

Speaker(s) 24 can emit sounds based on game actions and other game states and is controlled by a game control system as described subsequently. The front panel 14 can also include other features if appropriate. Player control panel 16 allows a player to manipulate events in the game, and includes player controls 30 such as an actuation device such as a push button to initiate the movement of the extraction device. Alternatively, the position of the starting point for the extraction device in the two dimensional X-Y vertical plane can be controlled by a joystick 25, roller ball, touchscreen, or other input device. Game action occurs in playing area 18, where a vacuum extraction device is moved in the playing area 18 using the joystick 25 or other controller device. The extraction device 42 is moved horizontally by the player using the player controls and joystick 25 to a position over the playing field where the prizes/gift cards are located, and the skill involved is the precision with which the player can accurately control the placement or movement of the extraction device 42.

At the bottom of the playing area 18 is a cylindrical column or silo 50, but the game can include multiple such silos. Each silo 50 includes an enclosure formed by a continuous wall that defines a target area, and houses a stack of gift cards 51. The target area formed by the silo wall is dimensioned so as to be slightly larger than the largest dimension (e.g., a diameter) of the extraction device 42. Thus, only by precisely hovering the extraction device 42 over the silo's target area can the player successfully lower the extraction device into the silo 50 to collect a gift card 51.

Figure 2:
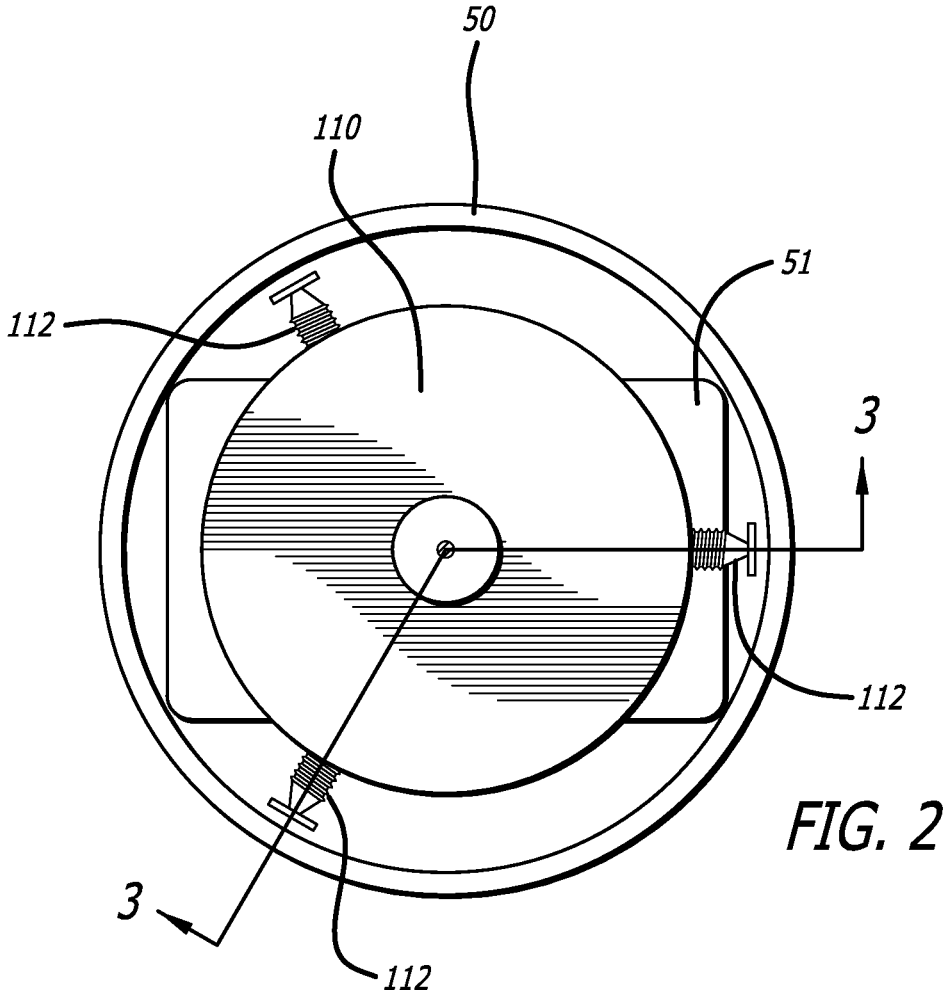
FIG. 2 is a top view of the extraction device of the embodiment of FIG. 1.
Figure 3:
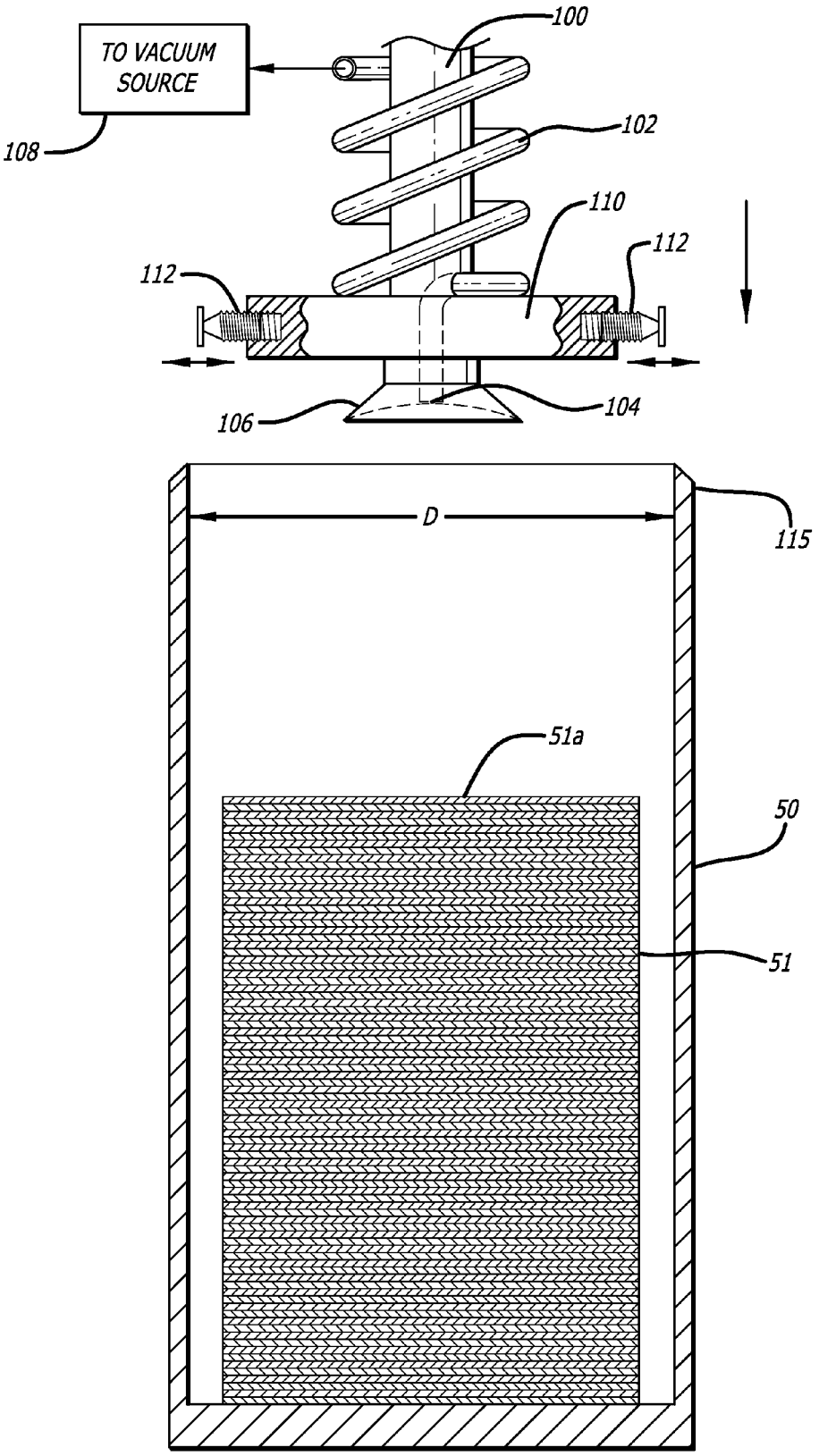
FIG. 3 is a cross-sectional view of the extraction device and silo of gift cards.
Figure 4:
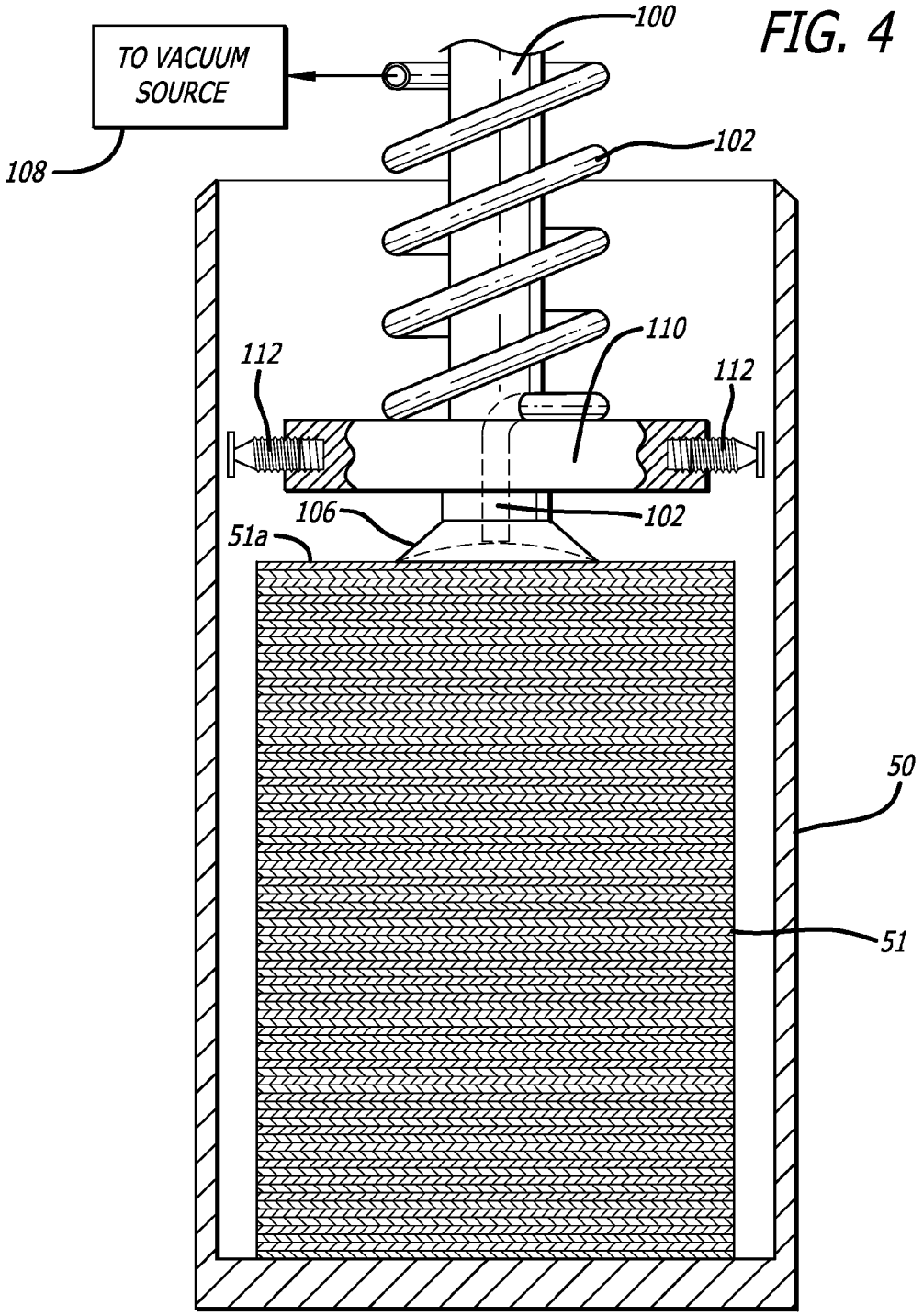
FIG. 4 is a cross-sectional view of the extraction device making contact with a gift card.
Figure 5:
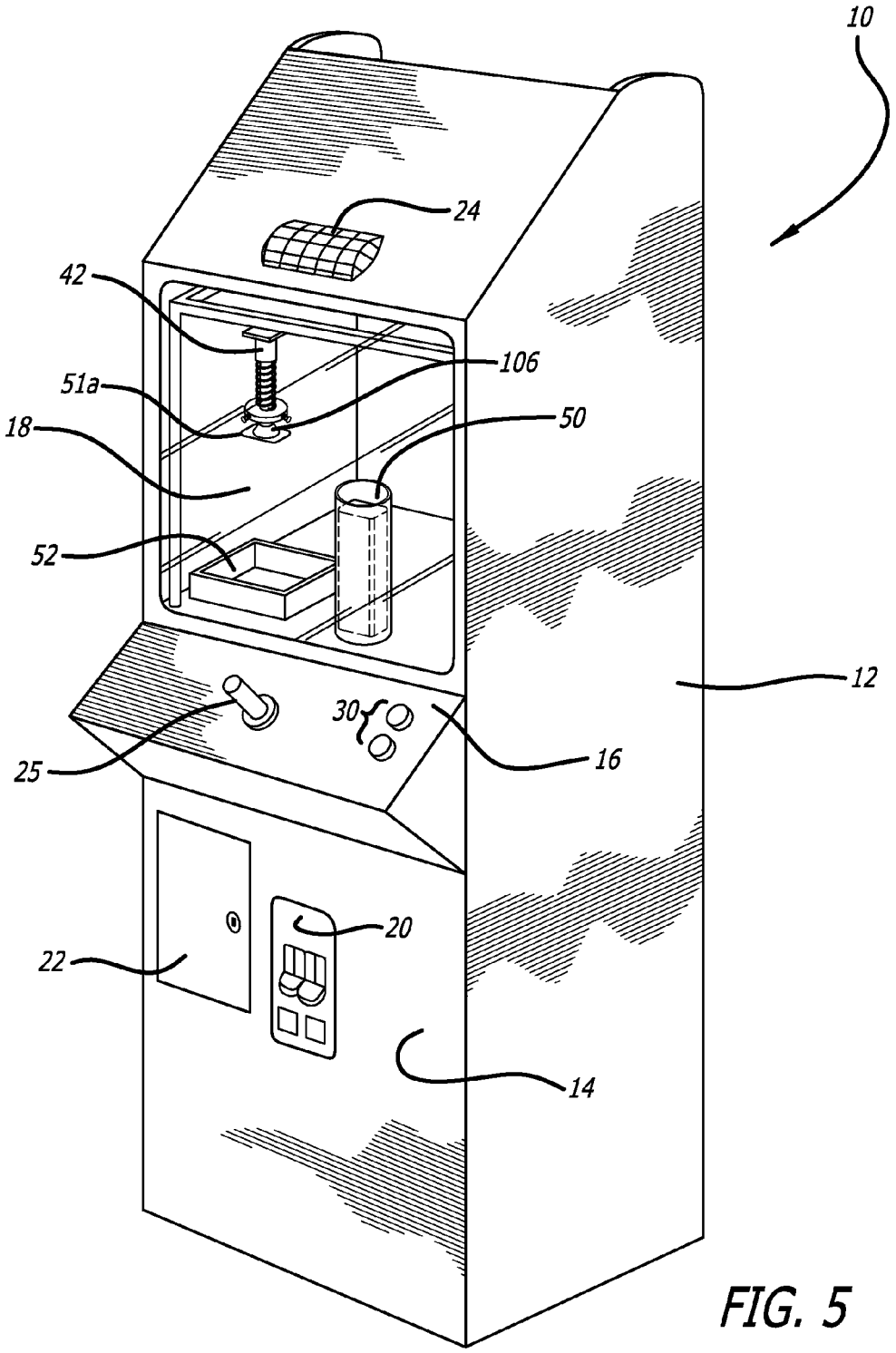
FIG. 5 is a perspective view of the extraction device transferring the captured gift card to a retrieval bin.

FIGS. 2 and 3 illustrate the extraction device in detail. A cylindrical rod 100 is connected to a motorized system for controlling the horizontal and vertical movement of the extraction device. A tube 102 is connected at a first end to a vacuum source 108 for creating a negative pressure in the tube 102, and a second end 104 terminates at a suction cup 106 with a flexible periphery. The position of the rod 100 is controlled by a motor, which in turn is controlled by a processor. The processor interprets movement by the joystick 25 and converts the joystick movements to a movement of the rod. Mounted on the rod is a block 110, which may be cylindrical or it may have other profiles. The block 110 has a width that is less than the inner diameter "D" of a silo 50 housing a stack of cards 51. The player must attempt to drop the extraction device into the silo 50 so that the suction cup 106 makes contact with the upper card 51*a* in the stack of cards 51. The vacuum source 108 communicates the negative pressure in the tube 102 to the suction cup, allowing the suction cup 106 to adhere to the upper card 51*a* (FIG. 4). Once the pressure is applied, the processor automatically lifts the extraction device vertically and moves the extraction device to a position over the retrieval bin 52 (FIG. 5). At this point, the processor sends a command to the vacuum source 108 to turn off the vacuum pump and activate the relief valve, releasing the gift card 51 from the adherence of the suction cup 106. The gift card will then fall into the retrieval bin 52, where it can be collected by the player.

To increase the difficulty of the game, the block 110 can be equipped with radial projections 112 that increase the width of the block 110. The radial projections 112 are preferably threaded so that they can be extended and inserted into the block 110 at a desired depth. As the radial projections extend the width of the block 110 to approximate the diameter D of the silo 50, the game becomes more challenging and more difficult to win. The radial projections and the amount of extension can be tied to the value of the gift cards, so that the more valuable the cards/prizes, the closer the width of the radial projections approximate the diameter D of the silo 50. The ability to adjust the difficulty of the game also allows younger players to play the game with larger tolerances, making the game more versatile for a greater range of player's abilities. Once the difficulty of the game has been set the play and skill level is the same for all players, young and old.

Figure 6:
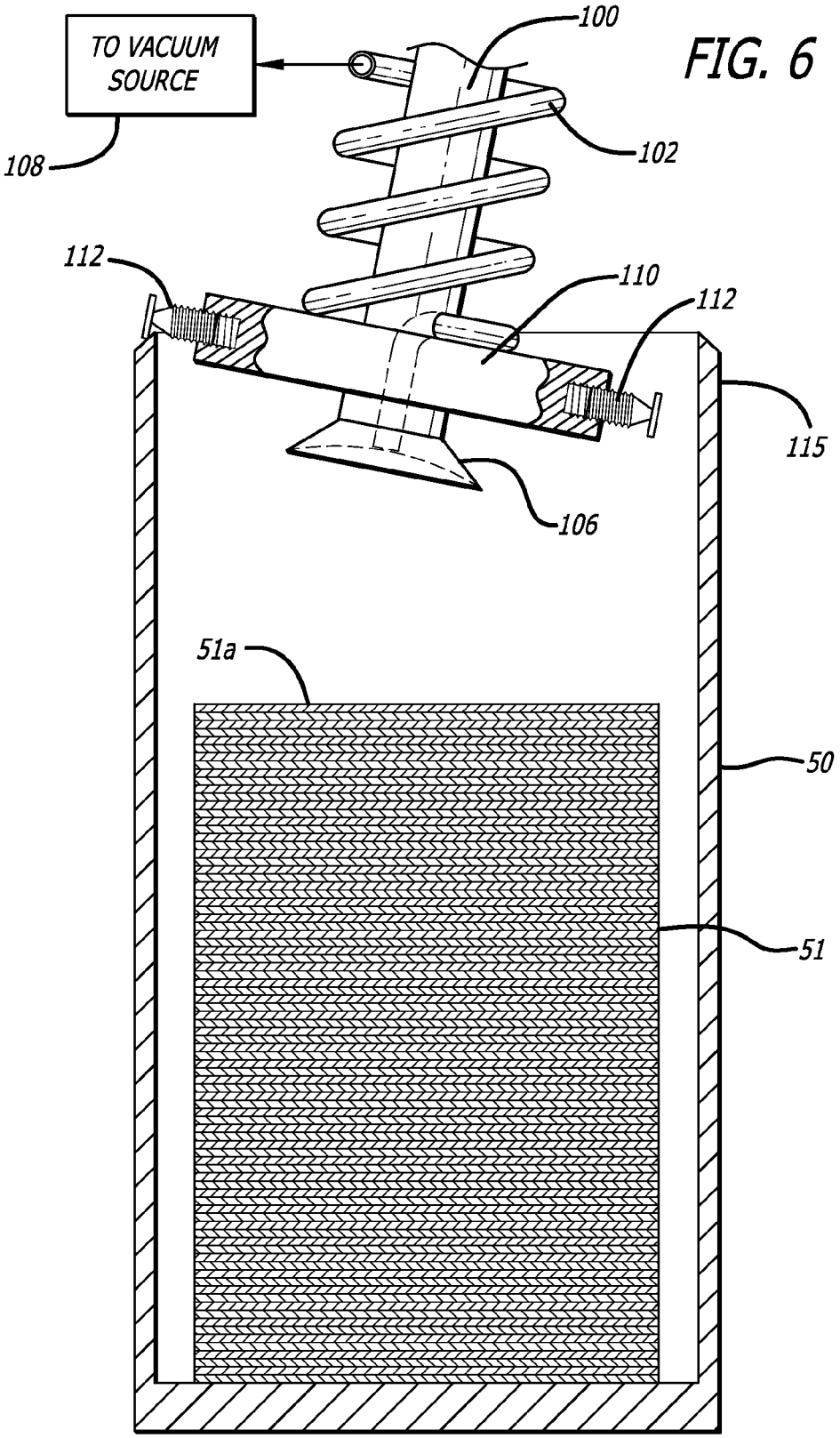
FIG. 6 is a cross-sectional view of the extraction device unsuccessfully attempting to make contact with the top gift card in the stack.

FIG. 6 illustrates what happens when the player does not successfully align the extraction device with the entrance to the silo 50, The radial projection 112 catches on the wall of the silo 50, preventing the extraction device from entering the silo successfully. The suction cup 106 will not make contact with the upper gift card 51*a*, and when the rod 100 is withdrawn, there will be no card attached to the extraction device. Thus, the attempt fails and the player cannot collect a prize. The game resets to a start up position awaiting the next player's attempt. The processor can receive signals from a vacuum switch that is activated when the card is successfully captured, thereby indicating a "win" for the player. The switch closes if a prize is picked up and remains open if no card is secured, and the signal to the processor is interpreted by the processor, which moves the crane accordingly.

The upper inside edge 115 of the silo's wall may be beveled so as to create an inclination from outer to inner radius, making it more difficult to direct the extraction device 42 directly into the silo 50. In the case of FIG. 6, the tilting of the extraction device 42 due to the radial projection 112 catching on the edge 115 of the outer wall 50 prevents that extraction device 42 from making contact with upper card 51*a*. On the other hand, in FIG. 3 the extraction device 42 is positioned to extend precisely into the silo's outer wall 50 and the radial projections 112 do not make contact with the outer wall 50. As a result, the extraction device 42 makes contact with the gift card 51*a*.

Figure 7:
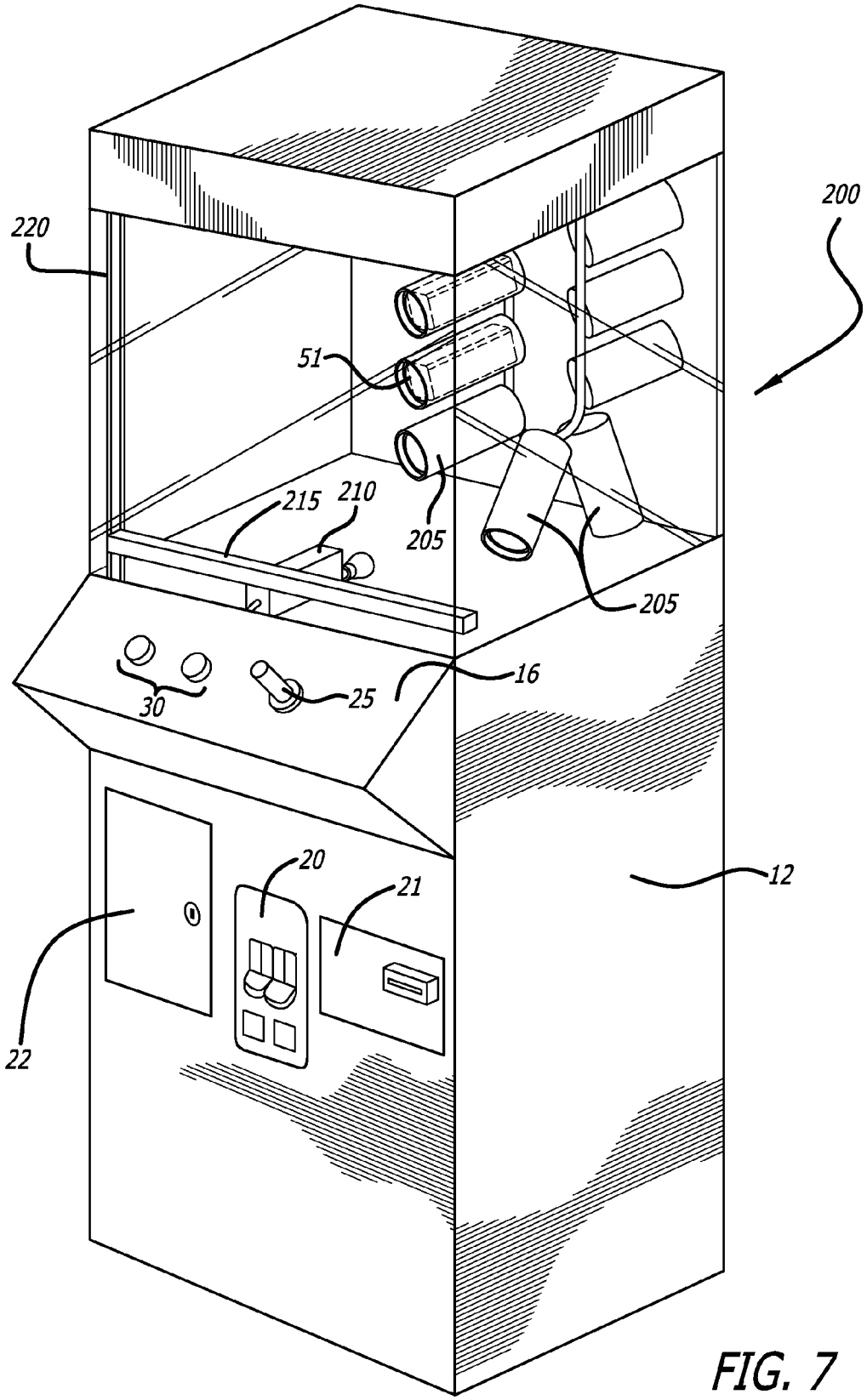
FIG. 7 is an elevated perspective view of a second embodiment of the present invention.

FIG. 7 illustrates a second embodiment 200 of the present invention, where the prizes are located in a horizontal tube 205 or tubes at the rear of the playing area 18. An extraction device 210 is mounted on a beam 215 with a drive train that can shift the position of the extraction device laterally to the left or right along the beam 215. The movement of the extraction device 210 is controlled by the player using the player controls 25, such as the joystick, mouse, button, roller, or the like. The beam 215 is itself mounted to a lift mechanism that moves the beam 215 along a vertical track 220, enabling the extraction device to freely in an X-Y plane when used in conjunction with the drive train, where the lift mechanism is also controlled by the player controls 25. Thus, the player using the player controls can position the extraction device anywhere in an X-Y plane, where the goal of the player is to align the extraction device horizontally and vertically with the horizontal tube 205.

Figure 8:
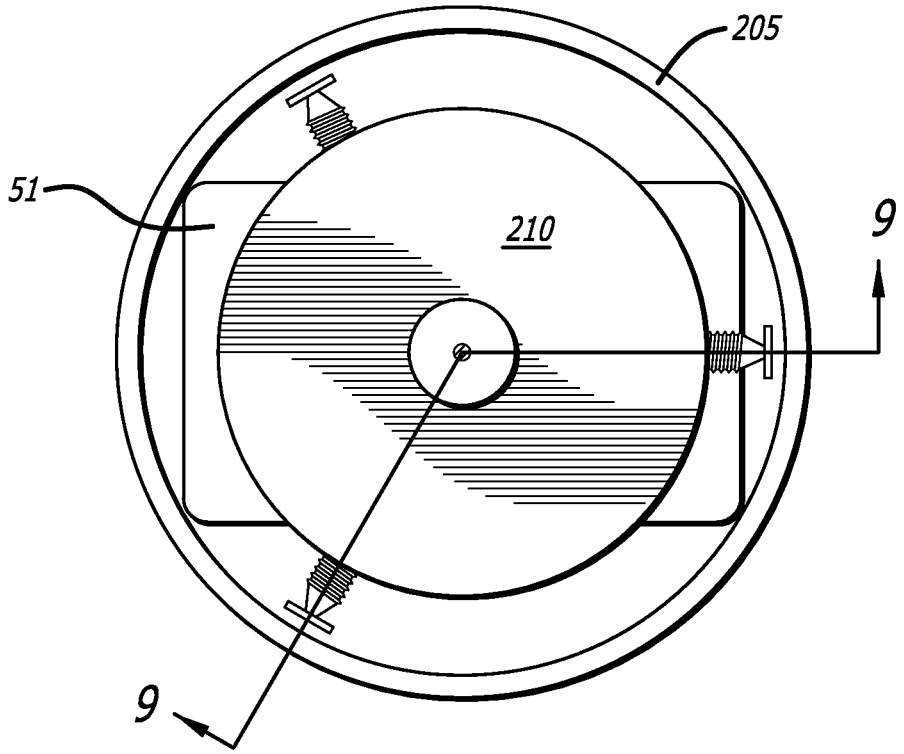
FIG. 8 is an enlarged, front view of the extraction device entering the horizontal tube.
Figure 9:
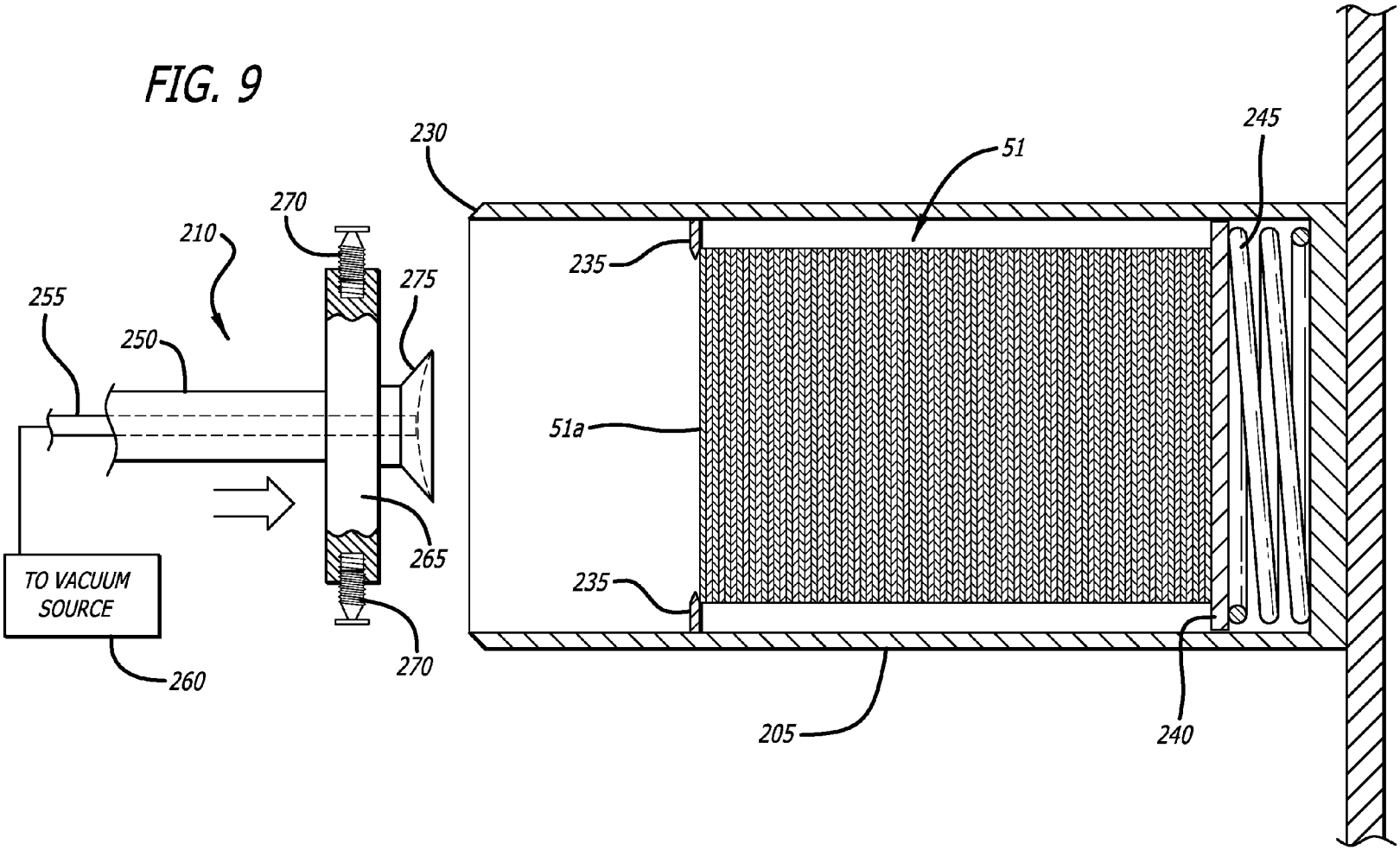
FIG. 9 is a cross sectional view taken along line 3-3 of the extraction device and horizontal tube.

FIG. 8 shows that the tube 205 presents a stack of cards 51 inside. The tube 205 holds up to one hundred cards or more, depending upon the application. The tube 205 is horizontally aligned and has an open first 230 end facing the extraction device 210, such that the cards are accessible through the tube. The cards can be held in place by mechanical means such as tabs 235, protrusions, etc., to prevent the cards 51 from falling out of the horizontal tube 205, where the tabs' retention of the cards is selected so as to be capable of being overcome by the extraction device 210, either through mechanical or electrical processes. That is, the tabs can automatically withdraw to allow a card to be extracted in one variation when a sensor determines that the extraction device 210 has made contact with the front card. However, the simplest solution is to select tabs that maintain the cards in the stack but will allow a card to pass when extracted by the extraction device 210.

A biasing plate 240 can be used to urge the stack of cards 51 against the tabs 235 by force applied from a spring 245, so that the card stack is always present at the tabs 235. The tube 205 may also include guides or other projections (not shown) that maintain a desired orientation of the card stack 51 and prevent the cards from twisting or jamming. The extraction device 210 comprises a rod 250 that can be mounted to the beam 215, and includes a vacuum tube 255 connected to a vacuum source 260. The rod 250 can include a cylindrical plate 265 that is mounted radially on the rod 250, where the diameter of the cylindrical plate 265 is less than a diameter of the tube 205 at the open end 230. To further refine the skill needed to win the game, small radial projections 270 can be mounted to extend from the perimeter of the cylindrical plate 265, where the distance between the center of the rod 250 to the outer tip of the radial projection 270 is approximate to, but slightly less than a radius of the tube 205. The small radial projections 207 can be threaded or insertable so as to be adjustable in the distance it protrudes from the cylindrical block 265, enabling the game operation to change the skill level of the game by adjusting the extension of the radial projections 270. Thus, if players are not winning the game at the desired success/failure ratio, the game owner can adjust this rate by extending the projections to make the game more difficult or withdraw the projections to make the game easier to win.

Figure 10:
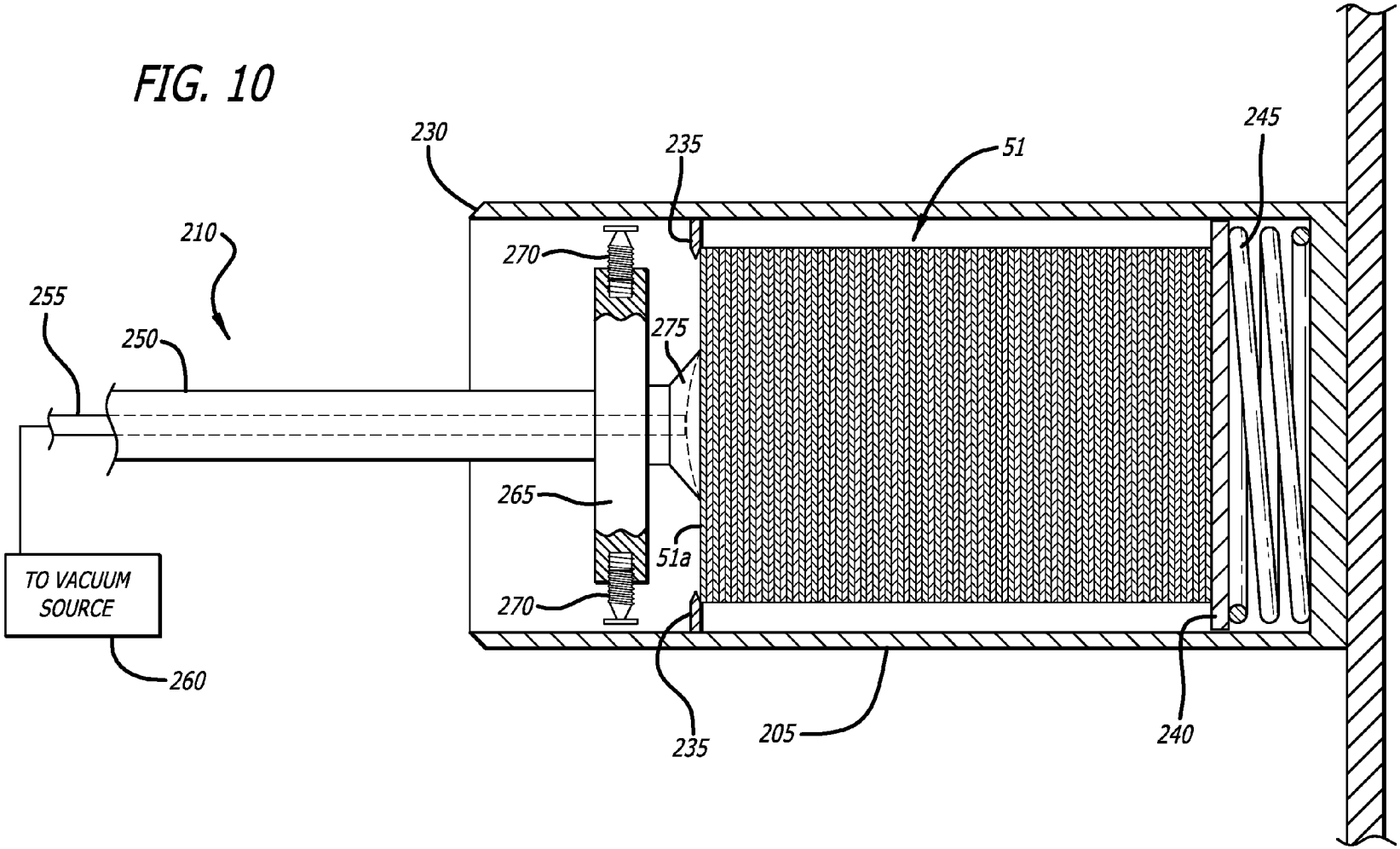
FIG. 10 is a cross sectional view of the extraction device making contact with a card.
Figure 11:
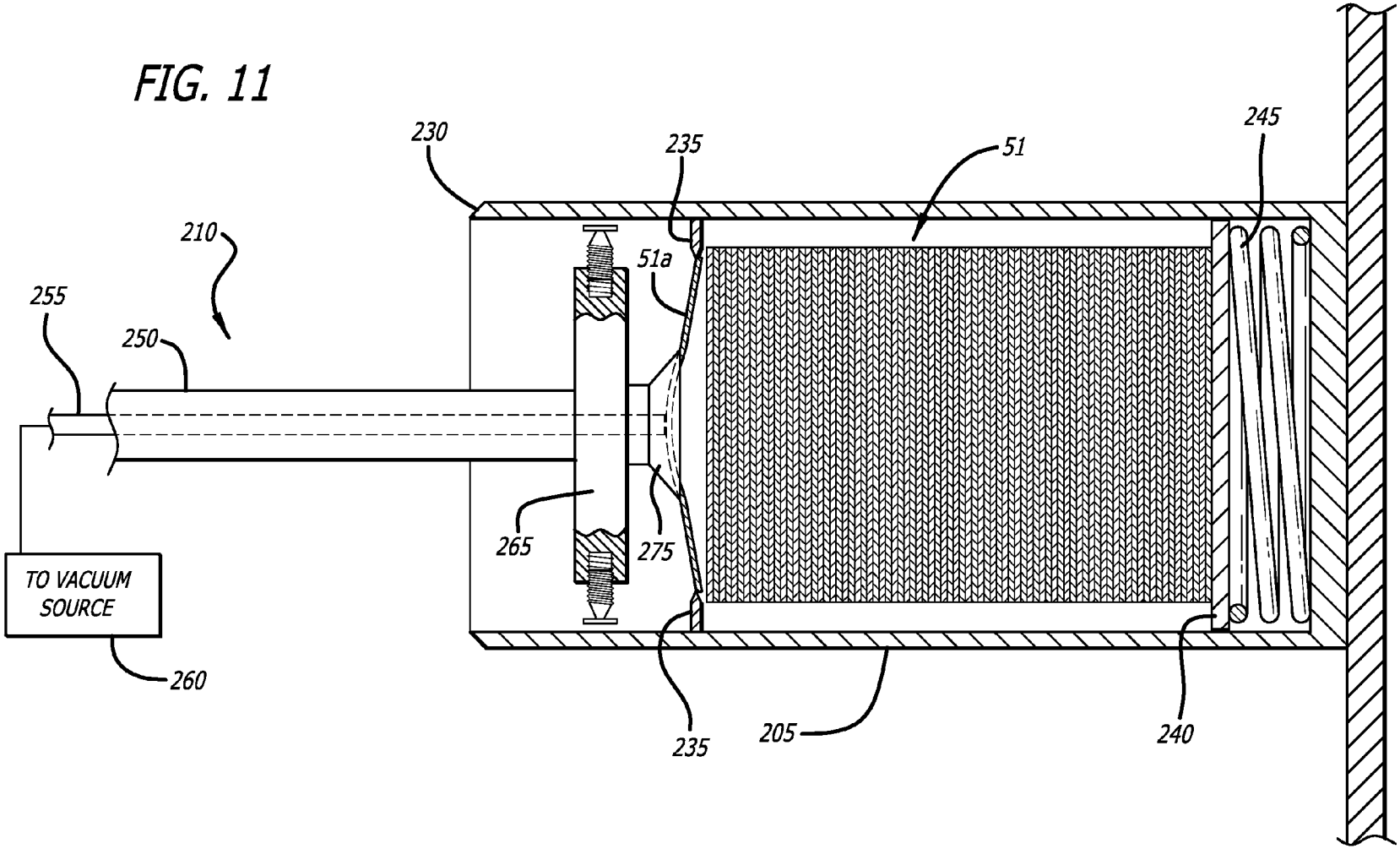
FIG. 11 is a cross sectional view of the extraction device removing a card from the stack inside the horizontal tube.
Figure 12:
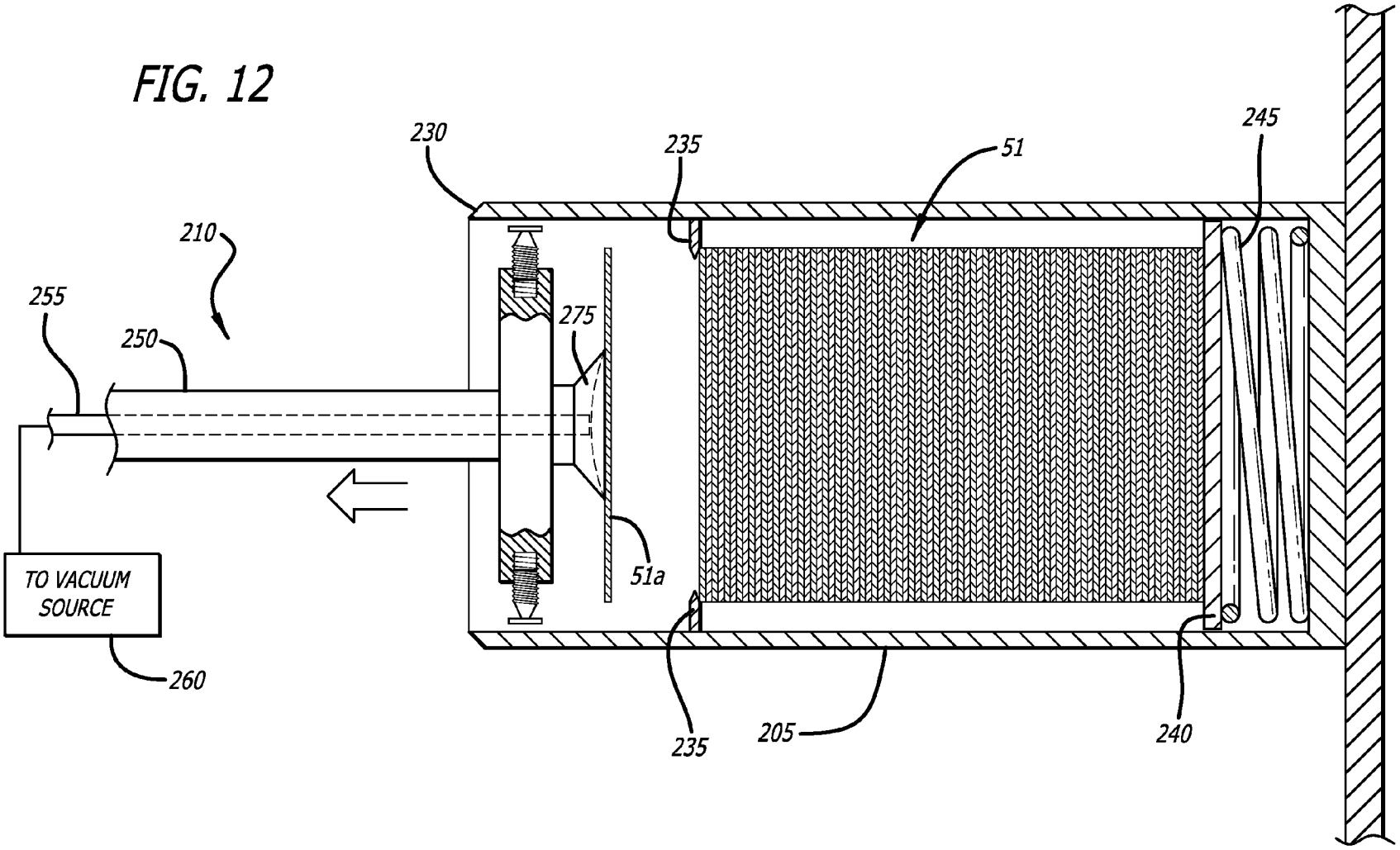
FIG. 12 is a cross sectional view of the extraction device removing a card from the horizontal tube.

FIGS. 10-12 illustrate the extraction process of winning a gift card by maneuvering the extraction device 210 into the tube 205. In FIG. 10, the player aligns the extraction device 210 so that the center of the rod 250 is colinear with the center of the tube 205. In this condition, the extraction device can enter the tube 205 with the cylindrical block (and radial projections 270) passing through the open end 230 of the tube 205. As the extraction device 210 continues into the tube 205, a suction cup 275 attached to the vacuum source 260 via the vacuum tube 255 engages and presses against an forwardmost card 51*a* in the card stack. The pressure of the extraction device 210, and particularly the suction cup 275, against the card 51*a* creates a suction force between the suction cup and the card. When the extraction device 210 begins to move out of the tube 205 (FIG. 11), the attraction of the suction cup 275 with the card 51*a* causes the card 51*a* to flex against the retention force of the tabs 235. Further movement of the extraction device 210 out of the tube 205 (FIG. 12) frees the card 51*a* from the stack 51 while the remainder of the stack 51 remains in place, compressed by the spring 245 and the plate 240 against the tabs 235.

Figure 13:
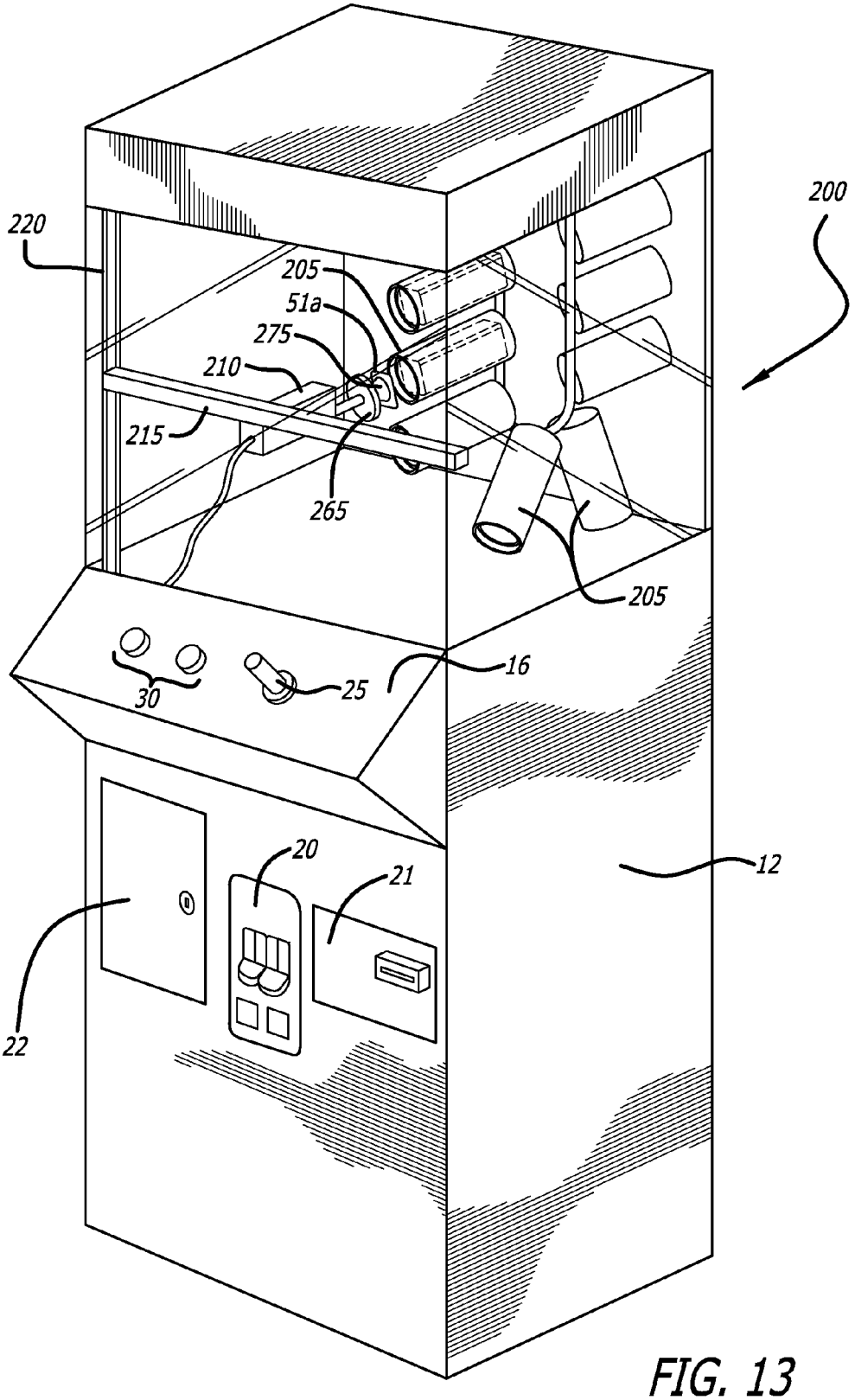
FIG. 13 is an elevated perspective view of the extraction device removing a card from the horizontal tube.

Once the extraction device 210 is free of the tube 205 (FIG. 13), the extraction device is moved over the retrieval bin 52 (see FIG. 1) and the processor sends a command to the vacuum source 260 to turn off the vacuum pump and activate the relief valve, releasing the card 51*a* from the adherence of the suction cup 275. The card 51*a* will then fall into the retrieval bin 52, where it can be collected by the player.

Figure 14:
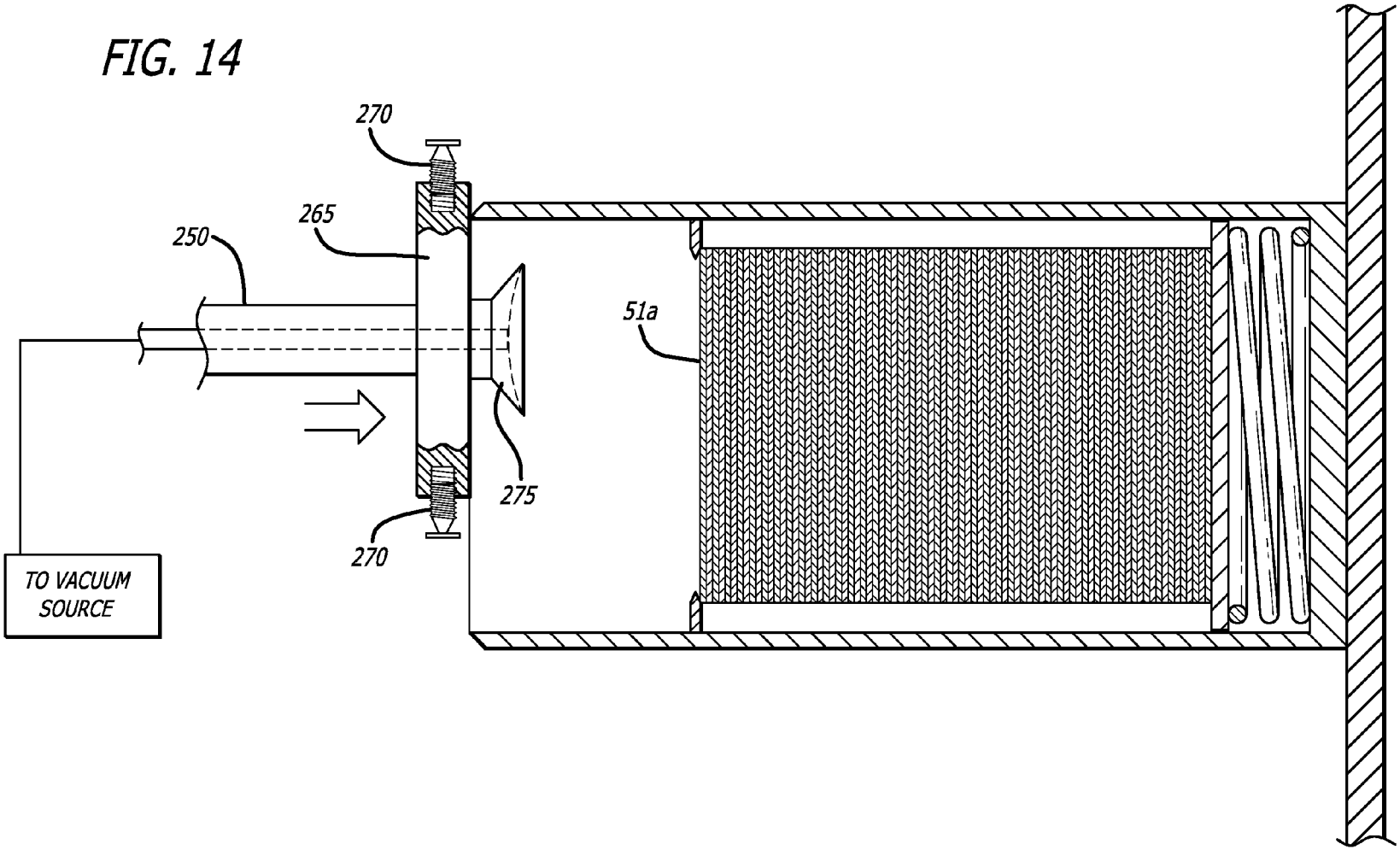
FIG. 14 is a cross sectional view of the extraction device failing to remove a card from the horizontal tube.

FIG. 14 illustrates what happens when the player does not successfully align the extraction device 210 with the entrance to the tube 205, The cylindrical plate 265 or the radial projection 270 makes contact with the wall of the tube 205 at the open end 230, preventing the extraction device 210 from entering the tube 205 successfully. The suction cup 275 will not make contact with the upper gift card 51*a*, and when the rod 250 is withdrawn, there will be no card attached to the extraction device. Thus, the attempt fails and the player cannot collect a prize. The game resets to a start up position awaiting the next player's attempt. The processor can receive signals from a vacuum switch that is activated when the card is successfully captured, thereby indicating a "win" for the player. The switch closes if a prize is picked up and remains open if no card is secured, and the signal to the processor is interpreted by the processor, which moves the crane accordingly.

Figure 15:
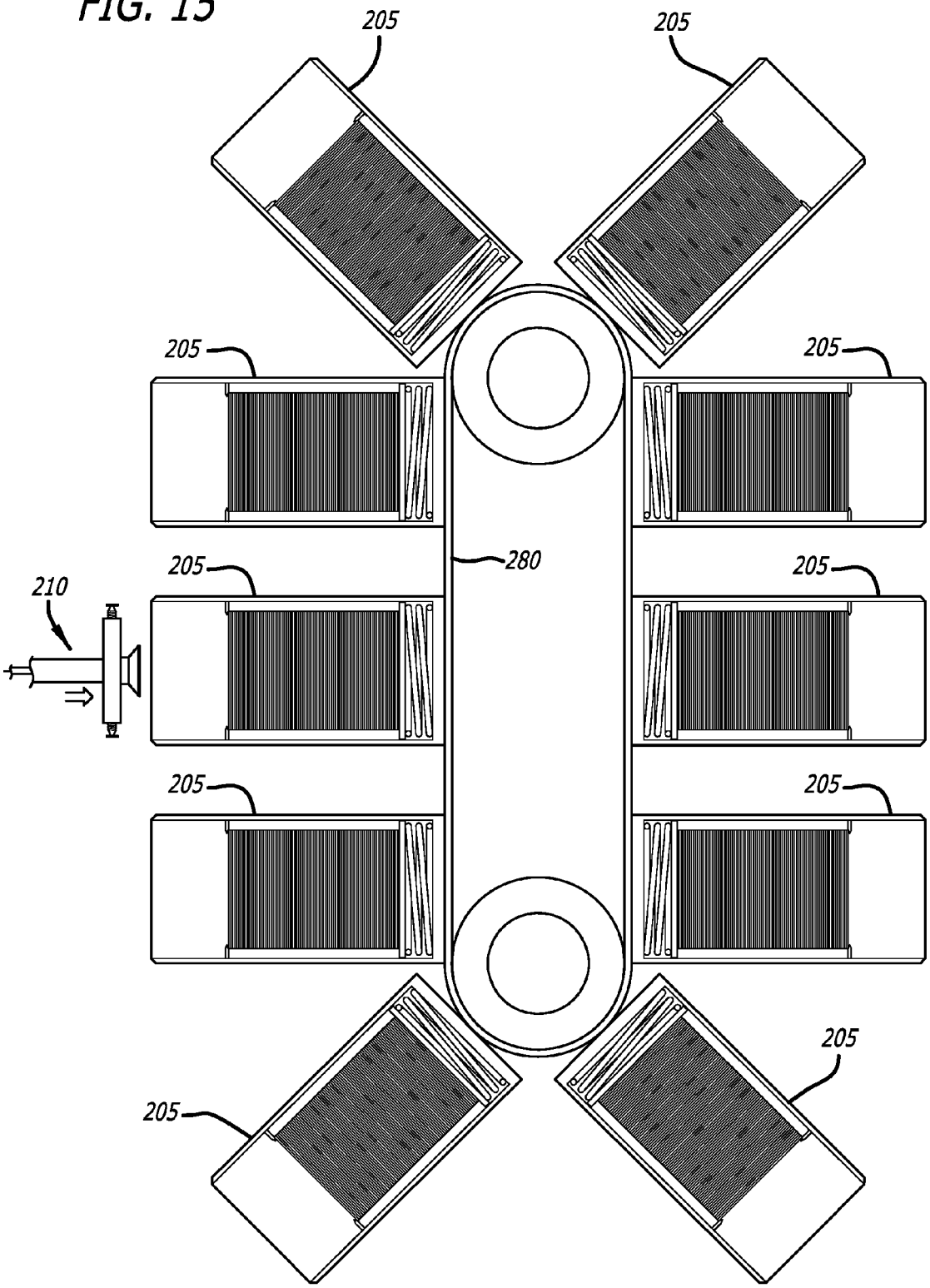
FIG. 15 is a side view of a conveyor showing multiple horizontal tubes of cards that can be rotated into place when a first tube is empty.

FIG. 15 illustrates a conveyor 280 that mounts a plurality of tubes 205, each tube filled with a stack of cards 51. The conveyor 280 rotates the tubes 205 in a path around the conveyor 280 as the tubes 205 empty, so that a new, full tube can replace the empty tube. This feature allows the owner of the game to eliminate the need to refill the game each time a tube is empty, reducing the time and maintenance needed to operate the game. The game 200 can include multiple rows of conveyors 280 to further expand the capacity of the game, where each conveyor is aligned side by side and can operate independently to rotate the conveyor when the tubes 205 are empty. A game could include a hundred tubes using this configuration, each tube containing a hundred cards. Obviously, other combinations of cards, tubes, and conveyors would readily be devices.

As one skilled in the art will appreciate, there are many modifications and alterations to the just-described embodiments that would be readily apparent to those skilled in the art, and such modifications and alterations are intended to be included within the scope of the invention. Accordingly, the invention should not be construed or limited to those just described embodiments, which are illustrative but not exclusive, but rather the scope of the invention should be determined by the words of the claims appended below using those words common and ordinary meanings within the context of the embodiments described above.

I claim:

1. An arcade target game, comprising:

a housing including player controls and a window in said housing for viewing action within the housing;

an extraction device movable via said player controls in an X-Y plane, the extraction device including radially extending projections adapted to be selectively lengthened in a radial direction and a suction device at a lower surface adapted to pick up a card;

a plurality of tubes mounted on a conveyor that rotates the plurality of tubes about the conveyor such that a first tube is always in a horizontal position opposed the extraction device, each tube containing a plurality of cards;

wherein the player controls maneuvers the extraction device into the tube of cards, and wherein the suction device can extract a card if the extraction device is correctly maneuvered into the horizontal tube.

2. The arcade target game of claim 1, wherein the radially extending projections are threaded into the extraction device for adjustable extension therefrom.

3. The arcade target game of claim 1, wherein an exterior wall of the first tube is circular.

4. The arcade target game of claim 3, wherein the exterior wall includes a beveled upper edge.

5. The arcade target game of claim 1, wherein a vacuum device is connection to the suction cup via a tube.

6. The arcade target game of claim 1, further comprising a relief valve to remove a negative pressure and allow the suction device to release a card.

7. The arcade target game of claim 1, further comprising a second conveyor mounting a second set of tubes, each conveyor operating independently to orient a tube in a horizontal position opposed the extraction device.

8. The arcade target game of claim 1, wherein each tube includes radially inwardly projecting tabs that retain a stack of cards therein.

* * * * *